US009738438B2

(12) United States Patent
Bisio

(10) Patent No.: US 9,738,438 B2
(45) Date of Patent: Aug. 22, 2017

(54) CAPSULE FOR PREPARING INFUSION BEVERAGES AND PROCESS FOR OPERATING SAID CAPSULE

(71) Applicant: Bisio Progetti S.p.A., Alessandria (IT)

(72) Inventor: Stefano Bisio, Alessandria (IT)

(73) Assignee: BISIO PROGETTI S.P.A., Alessandria (IT)

( * ) Notice: Subject to any disclaimer, the term of this patent is extended or adjusted under 35 U.S.C. 154(b) by 179 days.

(21) Appl. No.: 14/763,556

(22) PCT Filed: Jan. 15, 2014

(86) PCT No.: PCT/IT2014/000013

§ 371 (c)(1),
(2) Date: Jul. 27, 2015

(87) PCT Pub. No.: WO2014/118812

PCT Pub. Date: Aug. 7, 2014

(65) Prior Publication Data

US 2015/0353274 A1 Dec. 10, 2015

(30) Foreign Application Priority Data

Jan. 29, 2013 (IT) ..... TO2013A0067

(51) Int. Cl.
*B65D 85/804* (2006.01)

(52) U.S. Cl.
CPC ..... *B65D 85/8043* (2013.01)

(58) Field of Classification Search
CPC ..... B65D 85/8043
See application file for complete search history.

(56) References Cited

U.S. PATENT DOCUMENTS

2011/0185910 A1 8/2011 Ryser

FOREIGN PATENT DOCUMENTS

EP 2287090 A1 2/2011
EP 2289820 A1 3/2011
EP 2308776 A1 4/2011
(Continued)

OTHER PUBLICATIONS

International Search Report for PCT/IT2014/000013 mailed Jun. 18, 2014.

*Primary Examiner* — Erik Kashnikow
*Assistant Examiner* — Chaim Smith
(74) *Attorney, Agent, or Firm* — Thomas Horstemeyer, LLP

(57) ABSTRACT

A capsule (1) for preparing infusion beverages is described, composed of a containing tank (3) defining therein a room (5) adapted to contain a substance to be infused, the tank (3) being equipped with at least one opening (7) externally equipped on its perimeter with a circular edge (9) adapted to abut against a corresponding abutment edge (11) of a side wall of an infusion chamber (12) of a preparing machine inside which the capsule (1) is inserted, a surface face of the circular edge (9) being equipped with a sealing profile (15) composed of a first circular rib (17) and a second circular rib (19), the first and second ribs (17, 19) being concentric with respect to a main symmetry axis (S-S) of the capsule (1), each rib (17, 19) being flexible and the first and second ribs (17, 19) defining therebeween a seat (21) shaped as a circular crown adapted to house therein an end portion of the abutment edge (11) of the side wall of the infusion chamber (12).

7 Claims, 4 Drawing Sheets

(56) References Cited

FOREIGN PATENT DOCUMENTS

| | | | |
|---|---|---|---|
| EP | 2387922 | A1 | 11/2011 |
| EP | 2489609 | A1 | 8/2012 |
| WO | 2012118367 | A1 | 9/2012 |

CAPSULE FOR PREPARING INFUSION BEVERAGES AND PROCESS FOR OPERATING SAID CAPSULE

CROSS-REFERENCE TO RELATED APPLICATION

This application is the 35 U.S.C. §371 national stage application of PCT Application No. PCT/IT2014/000013, filed Jan. 15, 2014, which claims priority to and the benefit of, IT Patent Application No. TO2013A000067, filed Jan. 29, 2013, both of which are herein incorporated by reference in their entirety.

The present invention refers to a capsule for preparing infusion beverages, comprising in particular an edge equipped with an improved sealing profile.

As known, the art proposes a wide variety of automatic or semi-automatic machines equipped with a preparing and delivering assembly adapted to produce an infusion by means of the passage of hot water through a capsule containing the essence to be infused, the as for example tea, coffee, etc., placed inside a suitable infusion chamber.

In particular, capsules of a known type are a pre-packaged, disposable dose of the substance to be infused, closed inside an envelope, usually made of plastic material, the capsule being equipped with at least one circular perimeter edge usually adapted to guide the insertion and/or to guarantee keeping the correct position of the capsule inside the infusion chamber.

Moreover, the edge can sometimes be equipped with at least one sealing profile which increases the adherence with a related abutment edge of the infusion chamber in the a way as to make the infusion operation more efficient, limiting the dispersion of hot water outside the infusion chamber itself. Examples of the capsules are disclosed in EP-A-2308776 and EP-A-2289820. The sealing profiles however perform a single head sealing action between the capsule edge and its corresponding abutment edge of the infusion chamber, consequently performing a seal having a still limited efficiency.

Object of the present invention is solving the above prior art problems by providing a capsule for preparing infusion beverages comprising an edge equipped with a sealing profile adapted to be deformed and adapted to exert both a head seal and a side seal onto its corresponding abutment edge of the infusion chamber.

The above and other objects and advantages of the invention, as will appear from the following description are obtained with a capsule for preparing infusion beverages as claimed in claim 1. Preferred embodiments and non-trivial variations of the present invention are the subject matter of the dependent claims.

It is intended that all enclosed claims are an integral part of the present description.

It will be immediately obvious that numerous variations and modifications (for example related to shape, sizes, arrangements and parts with equivalent functionality) could be made to what is described, without departing from the scope of the invention, as appears from the enclosed claims.

The present invention will be better described by some preferred embodiments thereof, provided as a non-limiting example, with reference to the enclosed drawings, in which.

Figure 1:
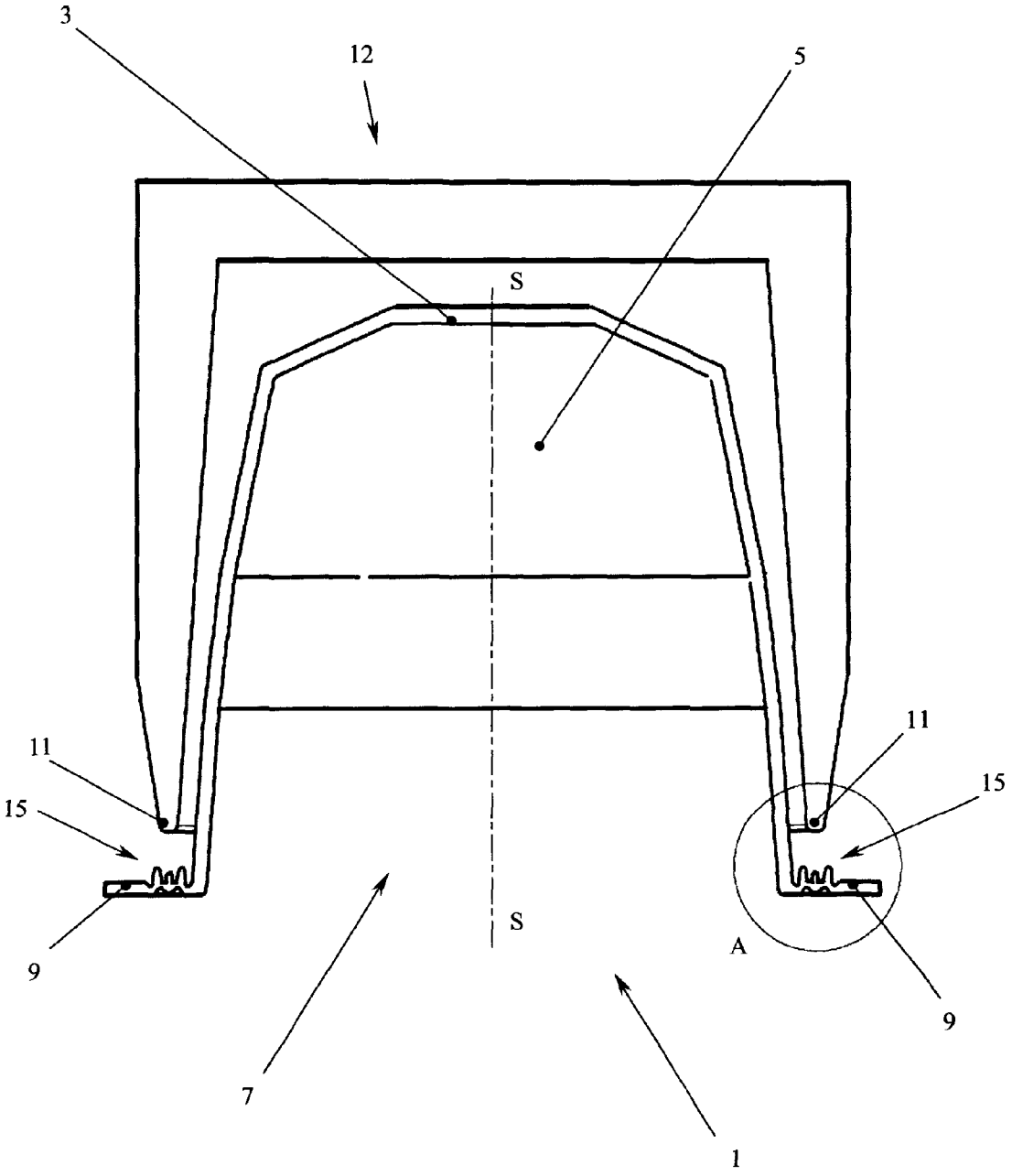
FIG. 1 shows a side sectional view of a preferred embodiment of the capsule according to the present invention.

With reference to the Figures, it is possible to note that the capsule 1 for preparing infusion beverages according to the present invention is composed of at least one containing tank 3 defining therein at least one room 5 adapted to contain at least one substance to be infused, the as for example coffee or tea, typically in granular or powdery form, the tank 3 being equipped with an opening 7 usually covered with a film adapted to be perforated or removed (not shown) to allow the passage of infusion water delivered by a preparing machine, of a substantially known type, through the capsule 1 itself, and consequently through the substance to be infused contained in the room 5, the opening 7 being equipped, outside and on its perimeter, with at least one circular edge 9 adapted to abut against a corresponding abutment edge 11 of a side wall of an infusion chamber 12 of the preparing machine, inside which the capsule 1 is inserted.

Advantageously, at least one surface face of the circular edge 9 is equipped with at least one sealing profile 15 composed of at least one first circular rib 17 and at least one second circular rib 19, the first and second ribs 17, 19 being concentric with respect to a main symmetry axis S-S of the capsule 1. Moreover, each one of the first and second ribs 17, 19 is flexible and the first and second ribs 17, 19 define therebetween at least one seat 21 shaped as a circular crown adapted to house therein at least one end portion of the abutment edge 11 of the side wall of the infusion chamber 12 and to center the capsule 1 upon inserting it into the infusion chamber 12.

Moreover, advantageously, the seat 21 is internally equipped with a third circular head rib 23 interposed between the first and the second ribs 17, 19, also concentric with respect to the main symmetry axis S-S, the circular head rib 23 being equipped with a flexible end 25 (which can be seen in FIGS. 4 to 7, which show the three operating steps of the progressive coupling and related squashing between flexible end 25 and abutment edge 11) adapted to get in contact with and to be squashed against the end portion of the abutment edge 11 in order to make a complete seal of the hot infusion beverage, preventing its entry into the infusion chamber 12 through the circular edge 9.

Figure 5:
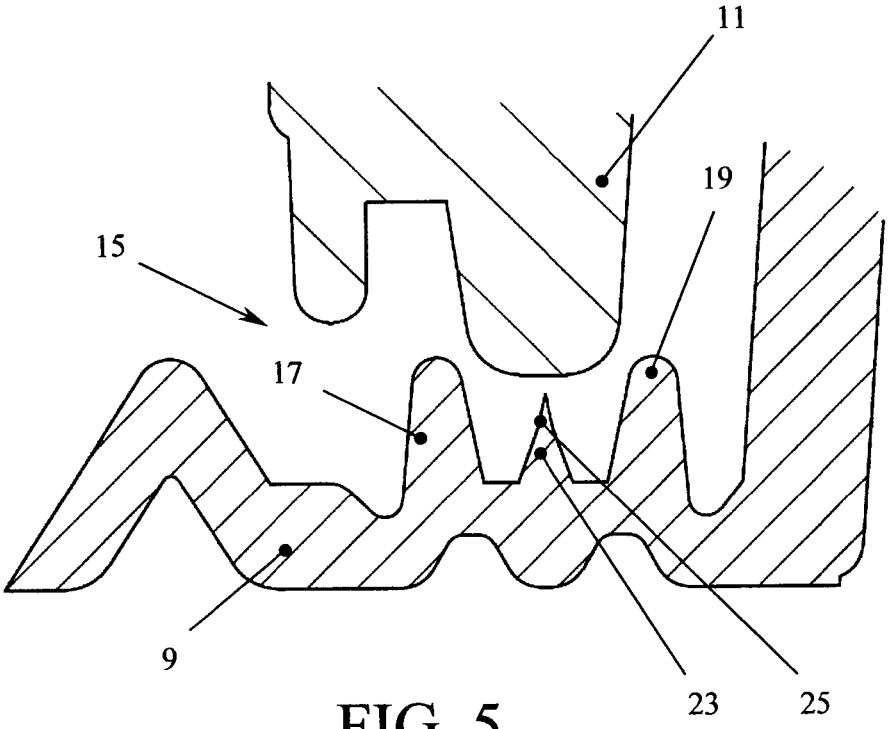
FIGS. 5 to 7 show the three operating steps of the capsule according to the present invention.
Figure 6:
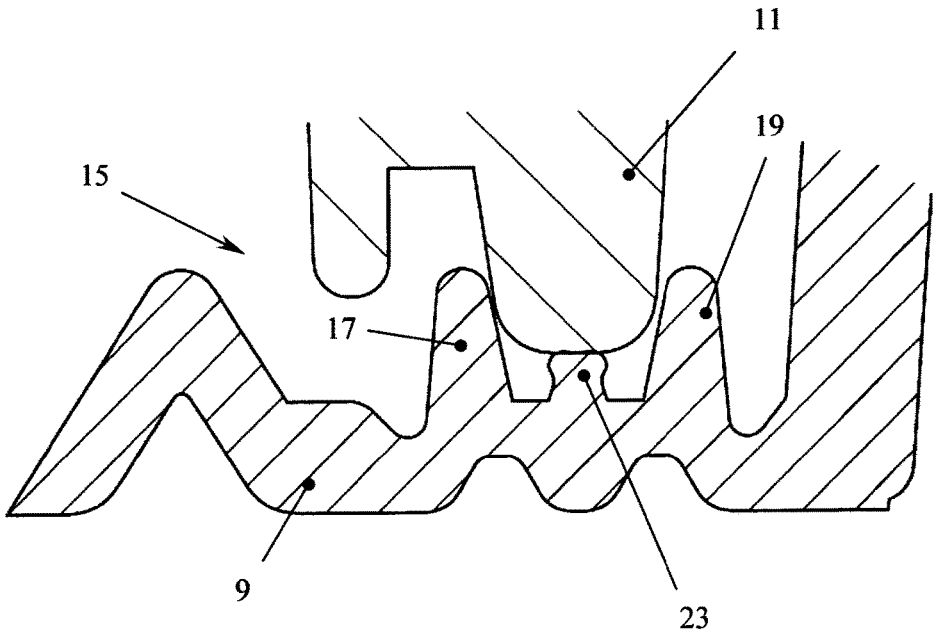
Figure 7:
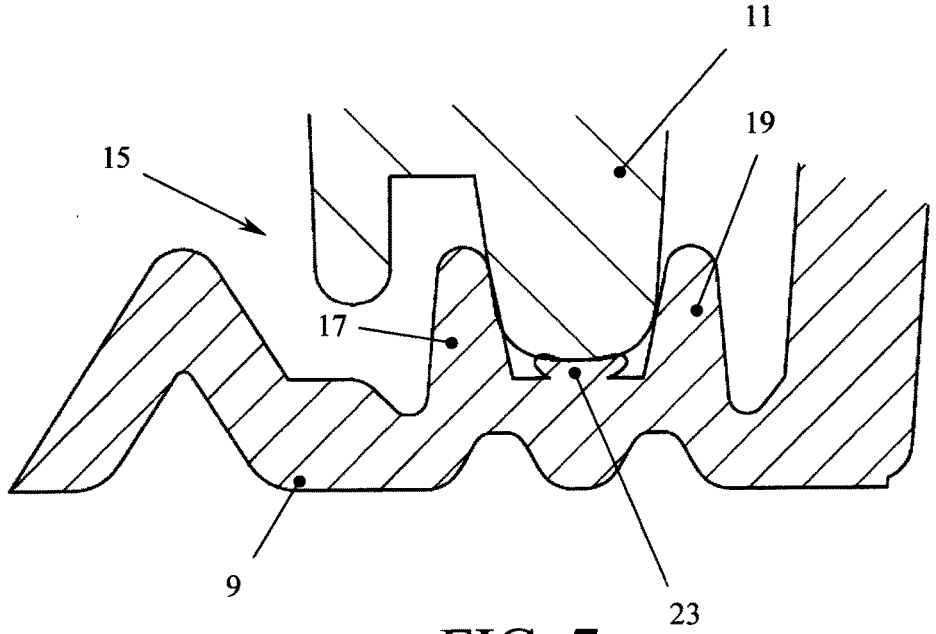

In fact, as can be seen in FIGS. 5 to 7, the flexible end 25 of the circular rib 23 (preferably made as a cusp or triangle, as shown), after having come in contact (FIG. 5) with the abutment edge 11, is progressively squashed by this, as shown in FIGS. 6 and 7, assuming the final configuration of FIG. 7 wherein an exit of the infusion beverage from the edge 9 is clearly prevented.

Figure 2:
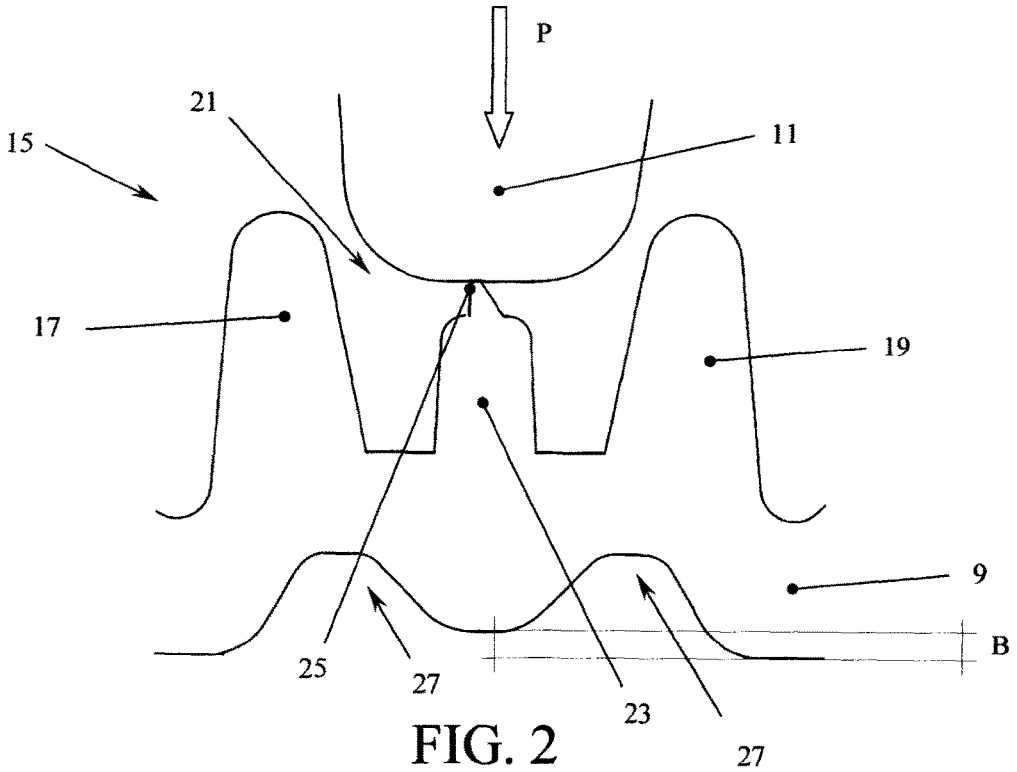
FIG. 2 shows an enlarged view of the part enclosed within circle A in FIG. 1 in a step of use of the capsule according to the present invention.
Figure 3:
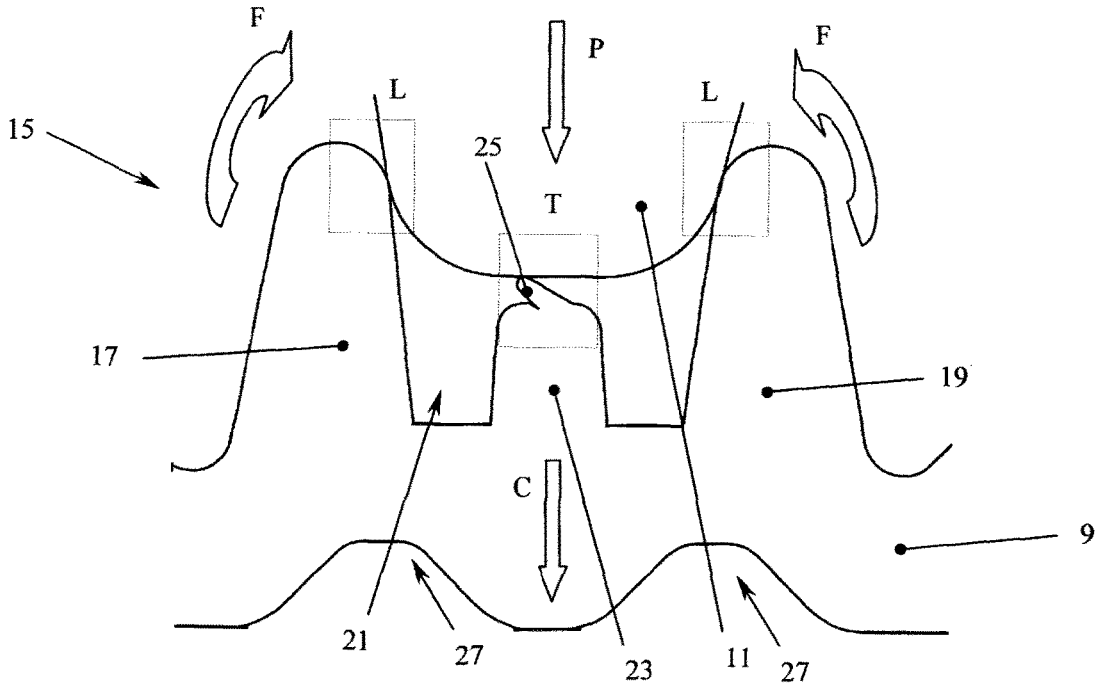
FIG. 3 shows an enlarged view of the part enclosed within circle A in FIG. 1 in a further step of use of the capsule according to the present invention.
Figure 4:
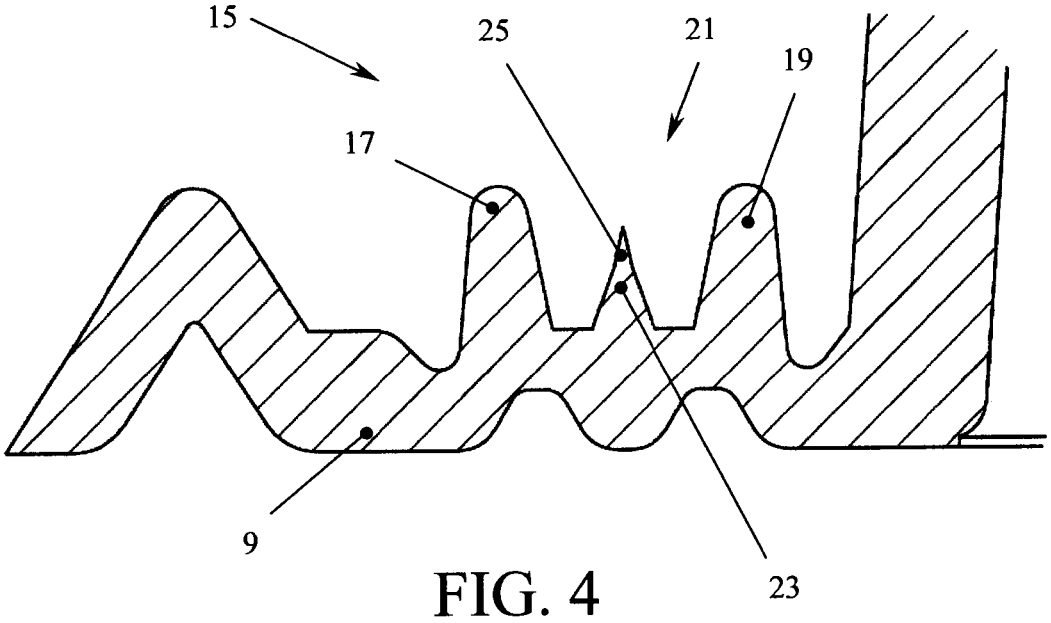
FIG. 4 shows a partial, enlarged sectional side view of the circular edge of the capsule according to the present invention.

According to a variation shown in FIGS. 2 and 3, the flexible end is composed of at least one flexible lip 25, the lip 25 preferably having a triangular shape in its section.

In particular, as it is possible to clearly note in FIGS. 2 and 3 seen in succession, if the width of the end portion of the abutment edge 11 is substantially equal to the width of the seat 21, the pressure (shown as an example by arrow P of FIGS. 2 and 3) of the circular edge 9 against the abutment edge 11, usually generated by the closing of the infusion chamber 12 through known mechanisms and kinematisms, causes the forced insertion of the end portion of the abutment edge 11 inside the seat 21 and the simultaneous elastic distortion of the ribs 17, 19 with their related flexure (shown as an example by arrows F in FIGS. 2 and 3) towards inside the seat 21 (favoured by the possible presence of one or more weight-reducing recesses 27 placed along the circular edge 9 opposed to the seat 21, through which recesses the base of the seat 21 can, due to the compression exerted by the pressure P, occupy, for example according to the movement shown by arrow C in FIG. 3, at least part of the space B determined by the weight-reducing recess 27), the sealing profile 15 consequently performing a sealing action both in the head (sealing area T in FIG. 3) possibly through the adherence of the third circular head rib 23, and in particular of the deformed flexible lip 25, against a head surface of the end portion of the abutment edge 11, and on the sides (sealing area L in FIG. 3) through the adherence of the surfaces of the ribs 17, 19 internal to the seat 21 and elastically distorted towards inside the seat itself, against the side surfaces of the end portion of the abutment edge 11.

Alternatively, if instead the width of the end portion of the abutment edge 11 is substantially greater than the width of the seat 21, the pressure of the circular edge 9 against the abutment edge 11, always generated by the closing of the infusion chamber 12, causes the compression of the ribs 17, 19 and their elastic flexure towards inside the seat 21, the sealing profile 15 consequently performing at least one head sealing action through the adherence of the surfaces at least of the ribs 17, 19 outside the seat 21 and elastically distorted towards inside the seat 21 itself against the head surfaces of the end portion of the abutment edge 11.

Obviously, at least the ribs 17, 19, 23 can be made of any flexible material, for example a plastic, thermoplastic material, etc., suitable for such purpose.

The invention claimed is:

1. A capsule for preparing infusion beverages composed of at least one containing tank defining therein at least one room adapted to contain at least one substance to be infused, said tank being equipped with at least one opening externally equipped on its perimeter with at least one circular edge adapted to abut against a corresponding abutment edge of a side wall of an infusion chamber of a preparing machine inside which said capsule is inserted, at least one surface face of said circular edge being equipped with at least one sealing profile composed of at least one first circular rib and at least one second circular rib, said first and second ribs being concentric with respect to a main symmetry axis of said capsule, each one of said first and second ribs being flexible and said first and second ribs defining therebetween at least one seat shaped as a circular crown adapted to house therein at least one end portion of said abutment edge of said side wall of said infusion chamber, characterized in that said seat is internally equipped with a third circular head rib interposed between said first and second ribs, said third circular head rib being concentric with respect to said main symmetry axis, said circular head rib being equipped with a flexible end adapted to get in contact with and to be squashed against said end portion of said abutment edge to perform a complete seal of the infusion beverage, preventing this latter one from entering the infusion chamber through said circular edge.

2. The capsule according to claim 1, characterized in that said flexible end is shaped as a cusp or a triangle in its section.

3. The capsule according to claim 1, characterized in that said flexible end is composed of at least one flexible lip projecting from the body of said third circular head rib.

4. The capsule according to claim 3, characterized in that said flexible lip has a section shaped as a triangle.

5. The capsule according to any claim 1, characterized in that said circular edge is equipped with one or more weight-reducing recesses placed opposed to said seat, at least one of said recesses making at least one space opposed to said seat.

6. A process for operating a capsule, the capsule for preparing infusion beverages composed of at least one containing tank defining therein at least one room adapted to contain at least one substance to be infused, said tank being equipped with at least one opening externally equipped on its perimeter with at least one circular edge adapted to abut against a corresponding abutment edge of a side wall of an infusion chamber of a preparing machine inside which said capsule is inserted, at least one surface face of said circular edge being equipped with at least one sealing profile composed of at least one first circular rib and at least one second circular rib, said first and second ribs being concentric with respect to a main symmetry axis of said capsule, each one of said first and second ribs being flexible and said first and second ribs defining therebetween at least one seat shaped as a circular crown adapted to house therein at least one end portion of said abutment edge of said side wall of said infusion chamber, characterized in that said seat is internally equipped with a third circular head rib interposed between said first and second ribs, said third circular head rib being concentric with respect to said main symmetry axis, said circular head rib being equipped with a flexible end adapted to get in contact with and to be squashed against said end portion of said abutment edge to perform a complete seal of the infusion beverage, preventing this latter one from entering the infusion chamber through said circular edge; and characterized in that a pressure of said circular edge against an end portion of said abutment edge having a width substantially equal to a width of said seat causes a forced insertion of said end portion of said abutment edge inside said seat and an elastic distortion of said ribs with their related flexure towards inside said seat, performing a sealing action both on the head through an adherence of said third circular head rib against a head surface of said end portion of said abutment edge, and on the sides through an adherence of surfaces of said first and second ribs inside said seat against the side surfaces of said end portion of said abutment edge.

7. A process for operating a capsule, the capsule for preparing infusion beverages composed of at least one containing tank defining therein at least one room adapted to contain at least one substance to be infused, said tank being equipped with at least one opening externally equipped on its perimeter with at least one circular edge adapted to abut against a corresponding abutment edge of a side wall of an infusion chamber of a preparing machine inside which said capsule is inserted, at least one surface face of said circular edge being equipped with at least one sealing profile composed of at least one first circular rib and at least one second circular rib, said first and second ribs being concentric with respect to a main symmetry axis of said capsule, each one of said first and second ribs being flexible and said first and second ribs defining therebetween at least one seat shaped as a circular crown adapted to house therein at least one end portion of said abutment edge of said side wall of said infusion chamber, characterized in that said seat is internally equipped with a third circular head rib interposed between said first and second ribs, said third circular head rib being concentric with respect to said main symmetry axis, said circular head rib being equipped with a flexible end adapted to get in contact with and to be squashed against said end portion of said abutment edge to perform a complete seal of the infusion beverage, preventing this latter one from entering the infusion chamber through said circular edge; and characterized in that a pressure of said circular edge against said end portion of said abutment edge having a width substantially greater than a width of said seat causes a compression of said first and second ribs and their elastic flexure towards inside said seat performing at least one head sealing action through an adherence of surfaces of at least said first and second ribs outside said seat and elastically distorted towards inside said seat at least against said head surfaces of said end portion of said abutment edge.

* * * * *